US011502399B2

(12) United States Patent
Li

(10) Patent No.: US 11,502,399 B2
(45) Date of Patent: Nov. 15, 2022

(54) ANTENNA DEVICE

(71) Applicants: Inventec (Pudong) Technology Corporation, Shanghai (CN); INVENTEC CORPORATION, Taipei (TW)

(72) Inventor: Chih-Cheng Li, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 92 days.

(21) Appl. No.: 17/131,798

(22) Filed: Dec. 23, 2020

(65) Prior Publication Data

US 2022/0140476 A1 May 5, 2022

(30) Foreign Application Priority Data

Nov. 5, 2020 (CN) ..... 202011225655.0

(51) Int. Cl.
*H01Q 1/22* (2006.01)
*H01Q 1/42* (2006.01)
*H01Q 1/38* (2006.01)

(52) U.S. Cl.
CPC ..... *H01Q 1/421* (2013.01); *H01Q 1/38* (2013.01)

(58) Field of Classification Search
CPC ..... H01Q 1/421; H01Q 1/38; H01Q 1/243; H01Q 1/24; H01Q 1/50; H01Q 1/22
See application file for complete search history.

(56) References Cited

U.S. PATENT DOCUMENTS

2009/0257207 A1 10/2009 Wang et al.
2013/0335275 A1* 12/2013 Sanford ..... H01Q 1/42 343/702
2021/0384614 A1* 12/2021 Lee ..... H01Q 1/48
2021/0400831 A1* 12/2021 Ma ..... H04M 1/0202

FOREIGN PATENT DOCUMENTS

CN 109980364 A 7/2019
TW 201431176 A 8/2014

* cited by examiner

*Primary Examiner* — David E Lotter
(74) *Attorney, Agent, or Firm* — CKC & Partners Co., LLC

(57) ABSTRACT

An antenna device includes a housing and a printed antenna. The housing includes a front glass shell, a rear glass shell, and a metal bracket. The metal bracket is between the front glass shell and the rear glass shell, and the metal bracket is connected to outer peripheries of the front glass shell and the rear glass shell to form an accommodation space together. The metal bracket includes a first frame portion, a second frame portion, and an opening, and the opening is defined between the first and second frame portions. The printed antenna is arranged in the housing and between the first and second frame portions, and the opening exposes at least a portion of the printed antenna.

8 Claims, 5 Drawing Sheets

ANTENNA DEVICE

CROSS-REFERENCE TO RELATED APPLICATION

This application claims priority to China Application Serial Number 202011225655.0, filed Nov. 5, 2020, which is herein incorporated by reference in its entirety.

BACKGROUND

Field of Invention

The present invention relates to antenna devices. More particularly, the present invention relates to printed circuit board (PCB) antenna devices.

Description of Related Art

By the characteristics of electromagnetic wave signals through space, wireless communication technology has been widely used for exchanging information, and relative applications have also dramatically grown due to the great range of needs. As wireless communication technology develops, the international standard of the $5^{th}$ generation (5G) mobile network has recently been established. In comparison with $4^{th}$ generation (4G) mobile networks, the 5G mobile network has a higher transmission rate, and communication needs in different ranges, such as near field or far field, can also be satisfied.

To comply with the 5G technology standard, a multi-feed antenna becomes a critical and low-cost option. On the other hand, the electric devices' appearance plays an important role to attract consumers, and displays account for high ratio on the electric devices'. The space for accommodating the multi-feed antennas is restrictively limited. Not only the distance between antennas is decreased, but also the space among the antennas and other components is narrow. Therefore, wireless communication is negatively affected since the antennas and other components mutually interfere and generate unwanted radiational coupling relationships.

SUMMARY

In some embodiments of the present disclosure, an antenna device includes a housing and a printed antenna. The housing includes a front glass shell, a rear glass shell, and a metal bracket. The metal bracket is disposed between the front glass shell and the rear glass shell, and the metal bracket is connected to outer peripheries of the front glass shell and the rear glass shell to form an accommodation space together. The metal bracket includes a first frame portion, a second frame portion, and an opening, and the opening is defined between the first and second frame portions. The printed antenna is arranged in the housing and between the first and second frame portions, and the opening exposes at least a portion of the printed antenna.

In some embodiments of the present disclosure, the metal bracket further includes a metal board, and the first and second frame portions are connected to a periphery of the metal board, the metal board and the first frame portion carry the printed antenna.

In some embodiments of the present disclosure, the opening includes a first opening portion and a second opening portion which communicates with the first opening portion, the first opening portion is disposed between the first and second frame portions, and the second opening portion is disposed between the first frame portion and the metal board.

In some embodiments of the present disclosure, the antenna device further comprises a plastic cap which is located among the front glass shell, the rear glass shell, and the metal bracket, and the plastic cap is filled into the opening.

In some embodiments of the present disclosure, the opening is substantially L-shaped.

In some embodiments of the present disclosure, the printed antenna includes a circuit board and a first radiating component, a second radiating component, and an isolating component which are printed on the circuit board, and the opening exposes at least one of the first and second radiating components.

In some embodiments of the present disclosure, the isolating component is disposed between the first and second radiating components.

In some embodiments of the present disclosure, the isolating component includes a first end, a second end, and a matching circuit which is disposed between the first and second ends, and the first end is a grounding end, the second end is electrically connected the metal bracket.

In some embodiments of the present disclosure, the matching circuit includes an inductance element and a capacitive element connected in series.

In some embodiments of the present disclosure, the front shell and the rear shell include high alumina glass.

In summary, the antenna device includes a housing and a printed antenna located in the housing, and the housing includes a front glass shell, a rear glass shell, and a metal bracket to protect the printed antenna. Therefore, the antenna device has an extraordinary mechanical property. Moreover, the metal bracket has a designed opening on the side thereof to expose the printed antenna so the printed antenna can avoid being interfered by the housing. Therefore, the printed antenna can efficiently send and receive signal, thus the antenna device can be well applied in specific operating bands.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
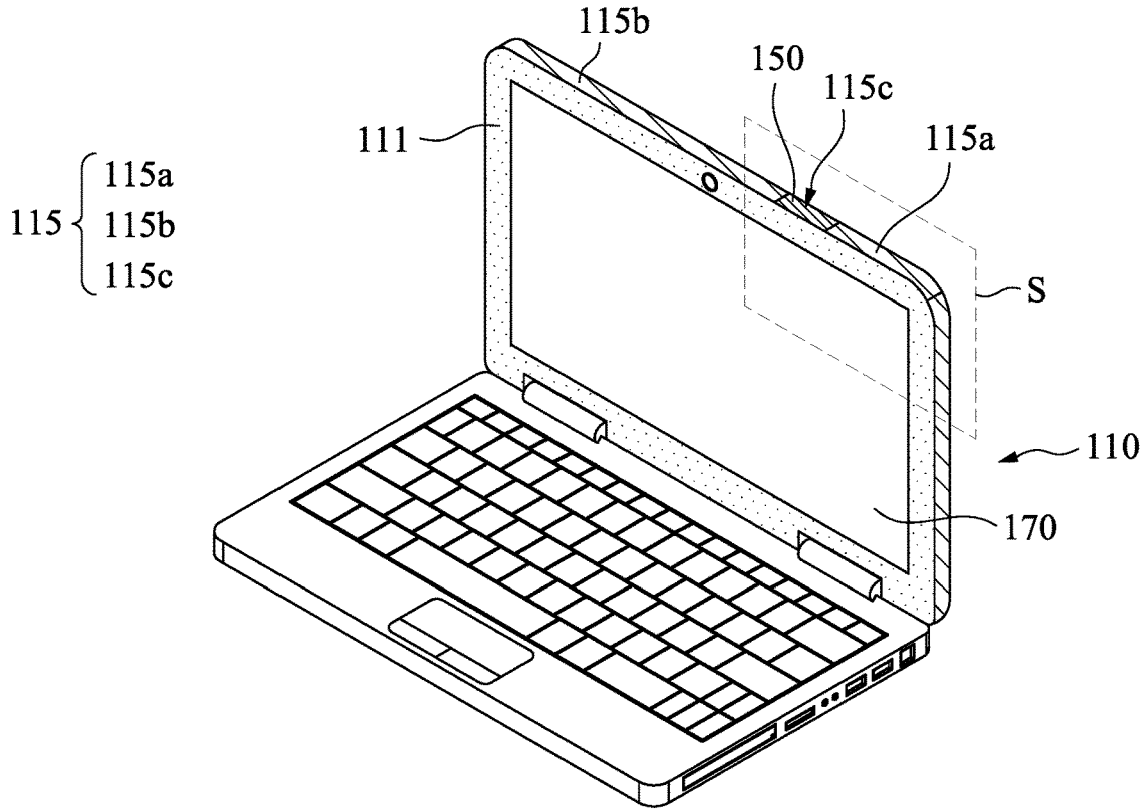
FIG. 1 illustrates a schematic view of the antenna device according to some embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

Reference is made to FIG. 1. FIG. 1 illustrates a schematic view of an antenna device 100 according to some embodiments of the present disclosure in some embodiments of the present disclosure. Specifically, the antenna device 100 is an electric device which can send and receive electromagnetic wave signals. Therefore, the antenna device 100 can be a mobile phone, a computer, or a laptop. For instance, the antenna device 100 includes a display panel 170 to show text, pictures, or videos. The present disclosure is not limited in this respect.

Figure 2:
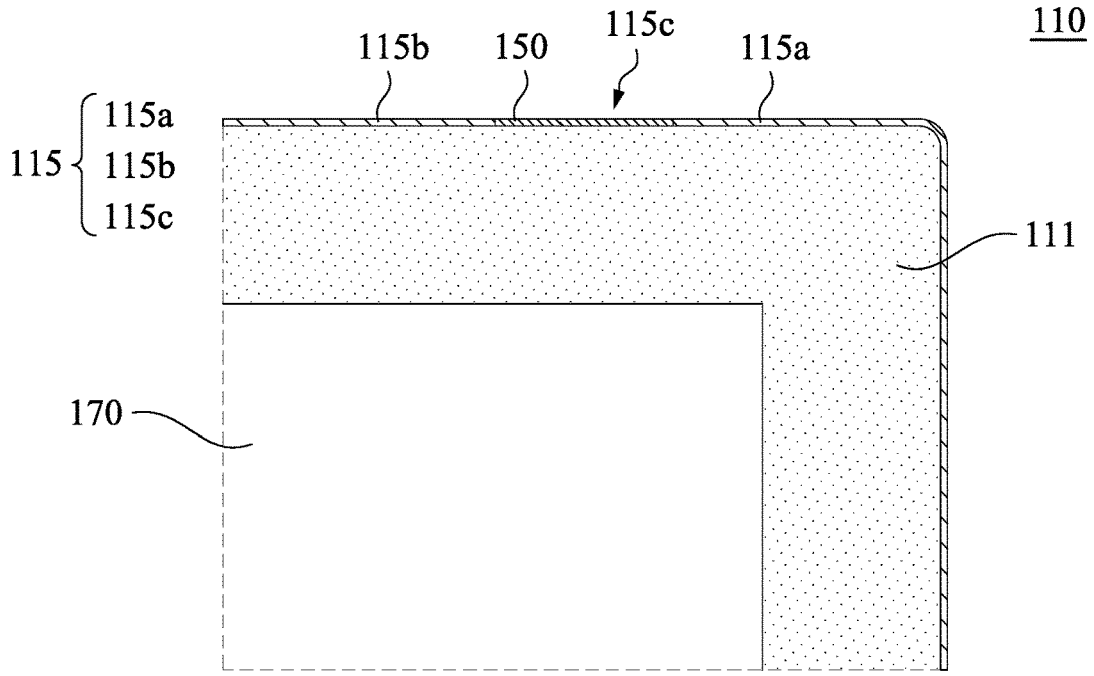
FIG. 2 illustrates a front view of the dotted square in FIG. 1.
Figure 3:
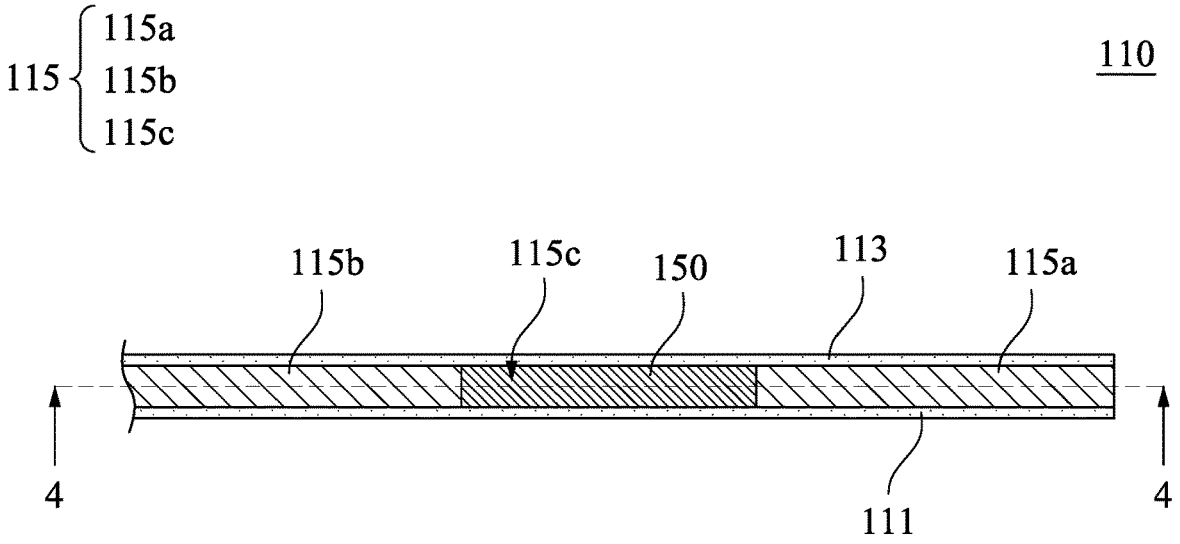
FIG. 3 illustrates a top view of the dotted square in FIG. 1.
Figure 4:
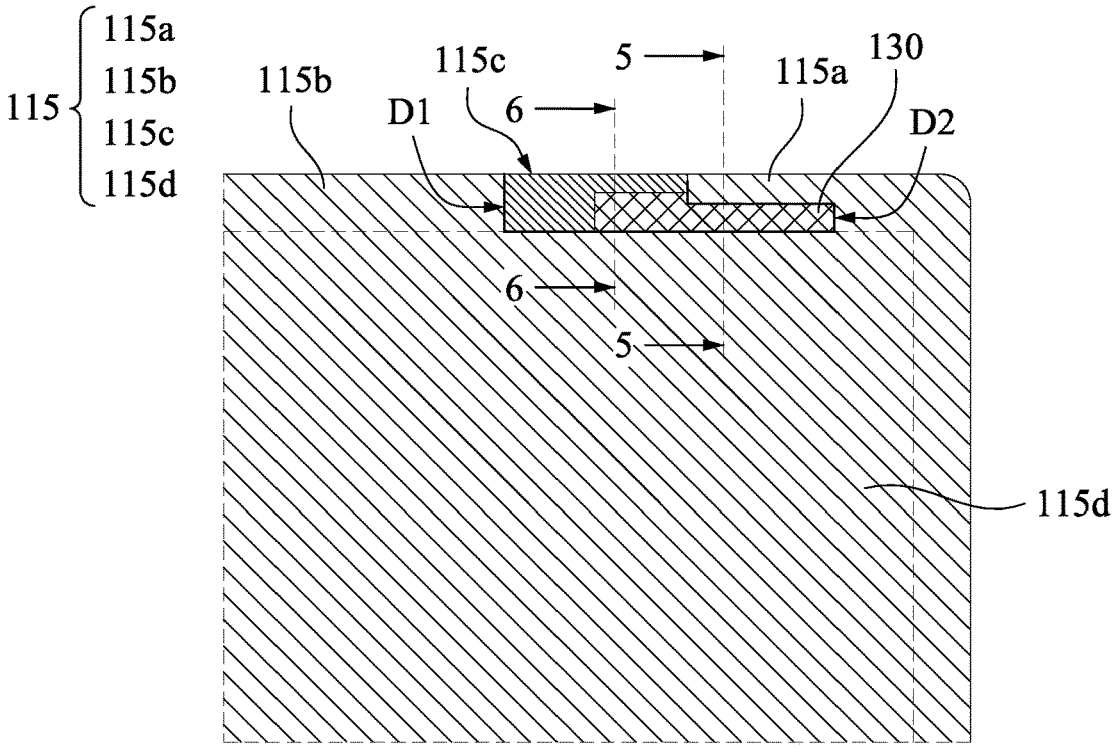
FIG. 4 illustrates a cross-sectional view taken along the section line 4-4 in FIG. 3.

Reference is made from FIG. 1 to FIG. 4. FIG. 2 illustrates a front view of the dotted square S in FIG. 1. FIG. 3 illustrates a top view of the dotted square S in FIG. 1. FIG. 4 illustrates a cross-sectional view taken along the section line 4-4 in FIG. 3. In some embodiments of the present disclosure, the antenna device 100 includes a housing 110 and a printed antenna 130. The housing 110 includes a front glass shell 111, a rear glass shell 113, and a metal bracket 115. The metal bracket 115 is disposed between the front glass shell 111 and the rear glass shell 113, and the metal bracket 115 is connected to outer peripheries of the front glass shell 111 and the rear glass shell 113 to form an accommodation space together. The metal bracket 115 includes a first frame portion 115*a*, a second frame portion 115*b*, as well as an opening 115*c*, and the opening 115*c* is defined between the first and second frame portions 115*a*, 115*b*. In FIG. 4, the printed antenna 130 is arranged inside the housing 110 and between the first and second frame portions 115*a*, 115*b*, and the opening 115*c* exposes at least a portion of the printed antenna 130. In this present disclosure, "the opening exposes at least a portion of the printed antenna" refers to the definition which a portion of the printed antenna 130 is exposed to the housing 110 without any other element taken in account. Moreover, the opening 115*c* is configured to prevent the printed antenna 130 from being negatively influenced by the housing 110. Therefore, the antenna device 100 can send and receive signals efficiently, and the housing 110 can protect hardware elements inside the antenna device 100, which means the antenna device 100 has excellent mechanical behaviors.

In some embodiments of the present disclosure, the metal bracket 115 of the housing 110 carries the front glass shell 111 and the rear glass shell 113, and both the front glass shell 111 and the rear glass shell 113 include high alumina glass. Therefore, the housing 110 has outstanding transparency, mechanical property, and hardness.

In some embodiments of the present disclosure, the metal bracket 115 further includes a metal board 115*d*, and the first and second frame portions 115*a*, 115*b* are connected to a periphery of the metal board 115*d*. The metal board 115*d* and the first frame portion 115*a* both carry the printed antenna 130, and the second frame portion 115*b* is separated from the printed antenna 130. The present disclosure is not limited in this respect. In alternative embodiments, the second frame portion 115*b* and the metal board 115*d* both carry the printed antenna 130, and the first frame portion 115*a* is separated from the printed antenna 130.

In some embodiments of the present disclosure, the opening 115*c* includes a first opening portion D1 and a second opening portion D2 which communicates with the first opening portion D1, the first opening portion D1 is located between the first and second frame portions 115*a*, 115*b*, and the second opening portion D2 is located between the first frame portion 115*a* and the metal board 115*d*. Specifically, the opening 115*c* is substantially L-shaped, and the L-shaped opening 115*c* helps the printed antenna 130 to efficiently send and receive signals.

In some embodiments of the present disclosure, the antenna device 100 further comprises a plastic cap 150, and the plastic cap 150 is located among the front glass shell 111, the rear glass shell 113, and the metal bracket 115, and the plastic cap 150 is filled into the opening 115*c*. Specifically, the plastic cap 150 is formed by Insert Molding, and the plastic cap includes an ABS resin (propenenitrile, butadiene, or phenylethene) and/or PC resin (polycarbonate). Moreover, the plastic cap 150 is directly connected among the front glass shell 111, the rear glass shell 113, and the metal bracket 115, thereby improving the mechanical property of the antenna device. The present disclosure is not limited in this respect.

Figure 5:
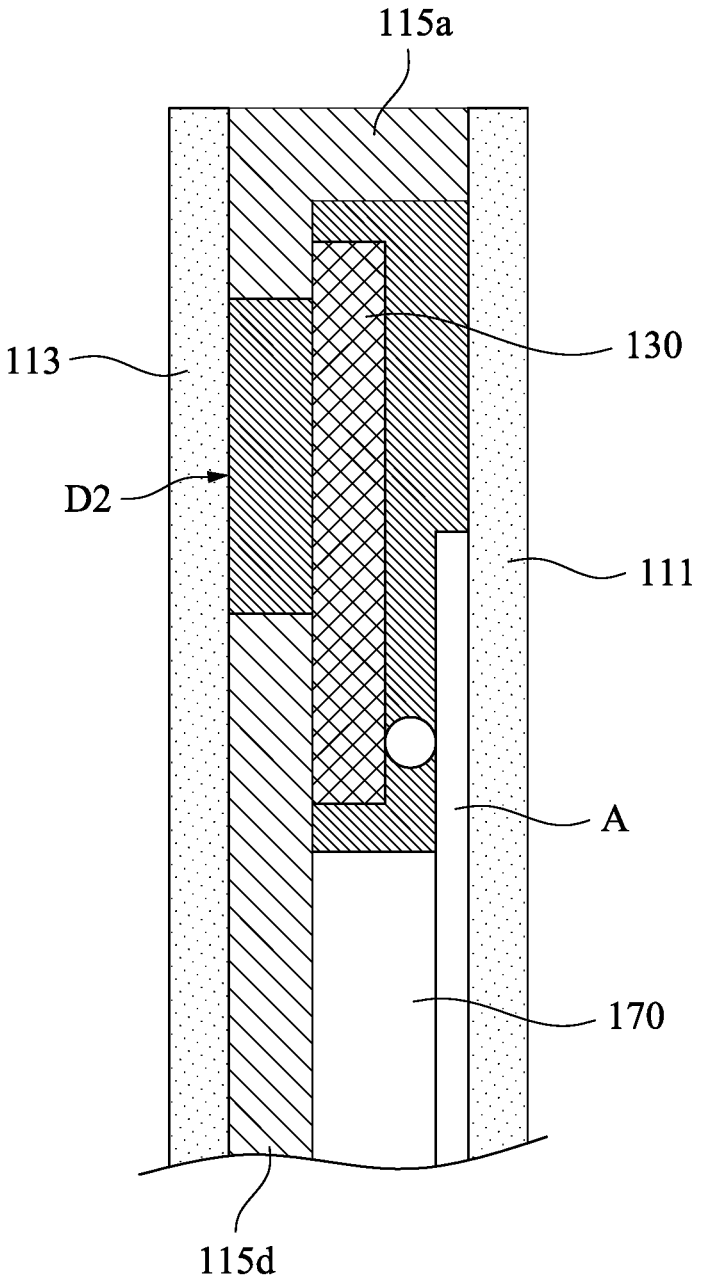
FIG. 5 illustrates a cross-sectional view taken along the section line 5-5 in FIG. 4.

Please refer from FIG. 1 to FIG. 5. FIG. 5 illustrates a cross-sectional view taken along the section line 5-5 in FIG. 4. In some embodiments of the present disclosure, the printed antenna 130 is disposed in the housing 110, and the first frame portion 115*a* and the metal board 115*d* are connected to the printed antenna 130. Specifically, both of the printed antenna 130 and the metal bracket 115 are disposed between the front glass shell 111 and the rear glass shell 113. Moreover, the first frame portion 115*a* includes a L-shaped profile (FIG. 5) which is fixed between the front glass shell 111 and rear glass shell 113, in which the first frame portion 115*a* also carries the printed antenna 130.

Figure 6:
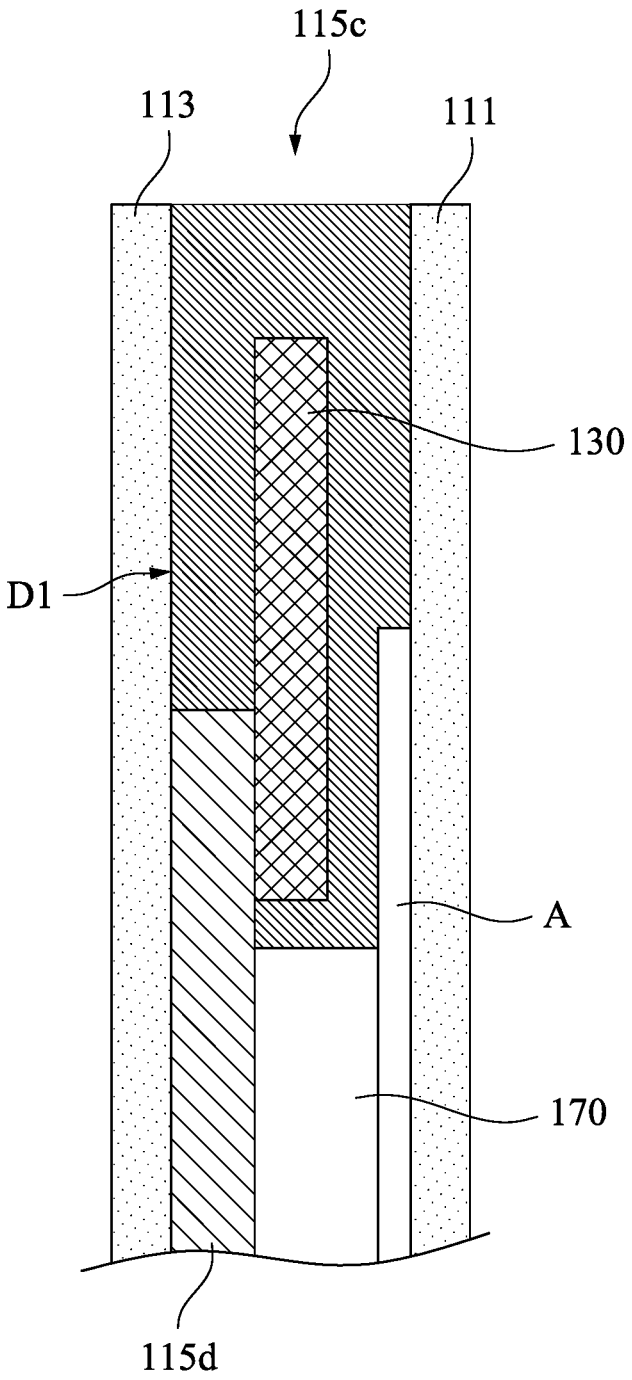
FIG. 6 illustrates a cross-sectional view taken along the section line 6-6 in FIG. 4.

Please refer from FIG. 1 to FIG. 6. FIG. 6 illustrates a cross-sectional view taken along the section line 6-6 in FIG. 4. In some embodiments of the present disclosure, the opening 115*c* of the housing 110 can expose the printed antenna 130 from its top, which takes only the housing 110 and the printed antenna 130 in account. The plastic cap 150 surrounds the printed antenna 130 and covers the printed antenna 130 from its top. The plastic cap 150 barely affect the printed antenna 130 from sending and receiving signals, thus the plastic cap 150 is suitable for covering and protecting the printed antenna 130.

Reference is made to FIG. 5 and FIG. 6. The antenna device 100 includes display panel 170 which has a display surface facing toward the front glass shell 111, and the display panel 170 is located between the front glass shell 111 and the rear glass shell 113. In some embodiments of the present disclosure, the display panel 170 is fixed to the front glass shell 111 by a transparent adhesive layer A which is disposed between the display panel 170 and the front glass shell 111, but the present disclosure is not limited in this respect.

Figure 7:
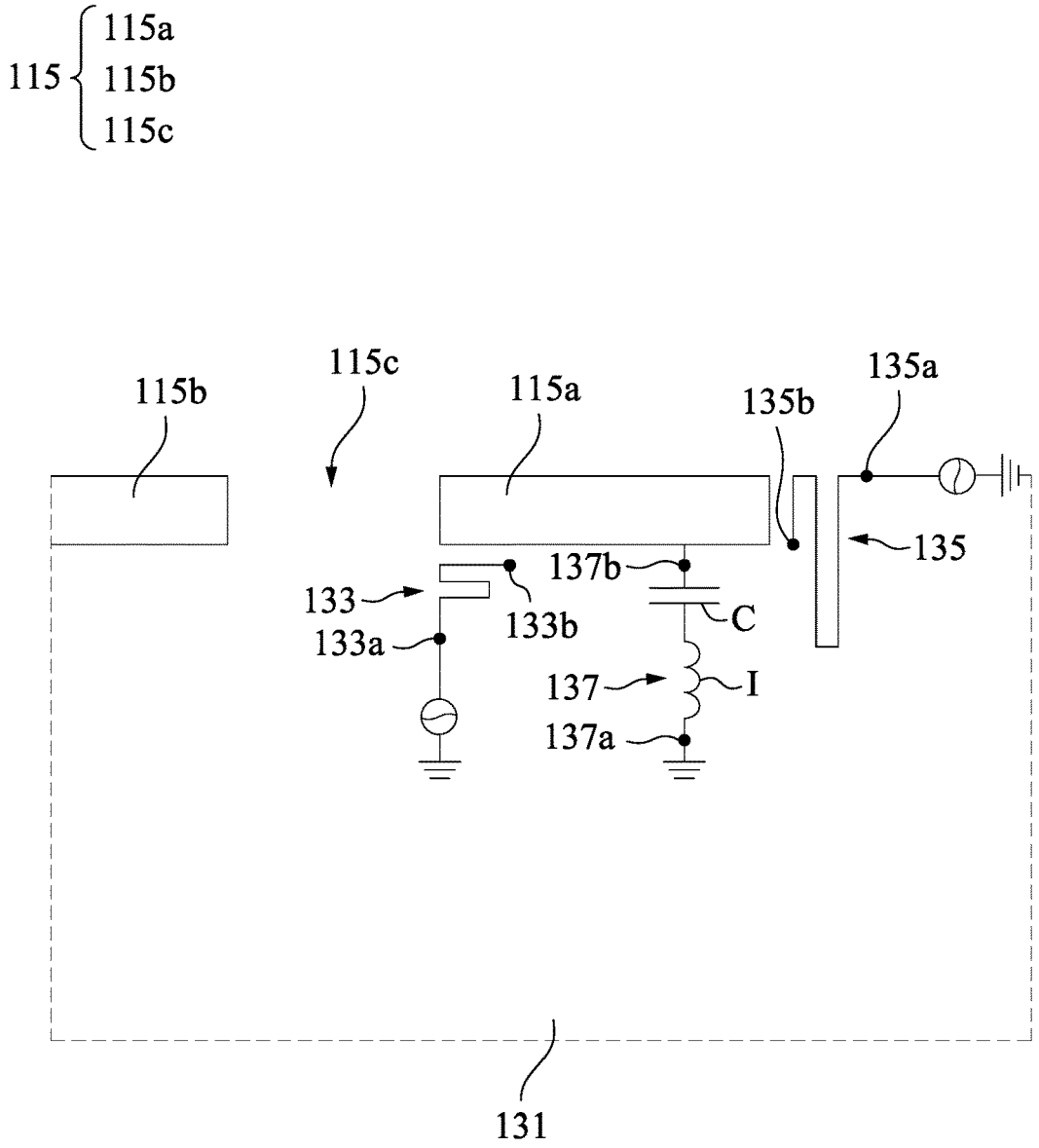
FIG. 7 illustrates a schematic circuit diagram of the printed antenna according some embodiments of the present disclosure.

Reference is made to FIG. 7. FIG. 7 illustrates a schematic circuit diagram of the printed antenna 130. In some embodiments of the present disclosure, the printed antenna 130 includes a circuit board 131, a first radiating component 133, a second radiating component 135, and an isolating component 137. The first radiating component 133, the second radiating component 135, and the isolating component 137 can be printed on the circuit board 131. Moreover, the opening 115*c* exposes at least one of the first and second radiating components 133, 135, thus the opening 115*c* can prevent the first radiating component 133 and second radiating component 135 from being affected by the surrounding housing 110 when the first and second radiating components 133, 135 are sending and receiving signals. The first radiating component 133 has a feeding end 133*a* and a free end 133*b* in which the feeding end 133*a* is configured to receive signals, and the free end 133*b* is separated from the metal bracket 115. In addition, the second radiating component 135 has a feeding end 135*a* and a free end 135*b*, in which the feeding end 135*a* is configured to receive signals, and the free end 135*b* is separated from the metal bracket 115. A wavy radiating portion is disposed between the feeding end 133*a* and the free end 133*b*. Another wavy radiating portion is also disposed between the feeding end 135*a* and the free end 135*b*. In real application, a direction or an angle between the first radiating component 133 and the second radiating component 135 can be adjusted according to the user's requirements, and the present disclosure is not limited in this respect. Moreover, the circuit board 131 is formed by an epoxy resin, and the first radiating component 133, the second radiating component 135, as well as the isolating component 137 can be printed on the circuit board 131 using copper foils.

In some embodiments of the present disclosure, the isolating component 137 is disposed between the first and second radiating components 133, 135, thus the isolating component 137 can prevent the first and second radiating components 133, 135 from interfering with each other. Specifically, the isolating component 137 includes a first end 137*a*, a second end 137*b*, and a matching circuit 137*c* which is disposed between the first and second ends 137*a*, 137*b*. The first end 137*a* is a grounding end, and the second end 137*b* is electrically connected to the metal bracket 115. In some embodiments of the present disclosure, the matching circuit 137*c* includes an inductance element I and a capacitive element C which are connected in series, thus the isolating component 137 can efficiently prevent the interference between the first and second radiating components 133, 135, thereby efficiently utilizing the first and second radiating components 133, 135 of the printed antenna 130 in multiple operating bands.

In summary, the antenna device includes a housing and a printed antenna located in the housing, and the housing includes a front glass shell, a rear glass shell, and a metal bracket to protect the printed antenna. Therefore, the antenna device has an extraordinary mechanical property. Moreover, the metal bracket has a designed opening on the side thereof to expose the printed antenna so the printed antenna can avoid being interfered by the housing. Therefore, the printed antenna can efficiently send and receive signal, thus the antenna device can be well applied in specific operating bands.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna device comprising:

a housing comprising:

a front glass shell;

a rear glass shell; and a metal bracket disposed between the front glass shell and the rear glass shell, and the metal bracket is connected to a periphery of the front glass shell and the rear glass shell to collectively form an accommodation space, wherein the metal bracket includes a first frame portion, a second frame portion, and an opening which is defined between the first and second frame portions; and a printed antenna is disposed in the housing and between the first and second frame portions, and the opening exposes at least a portion of the printed antenna, wherein the metal bracket further includes a metal board, the first and second frame portions are connected to a periphery of the metal board, and the metal board and the first frame portion carry the printed antenna, the opening comprises a first opening portion and a second opening portion which communicates with the first opening portion, the first opening portion is between the first and second frame portions, and the second opening portion is between the first frame portion and the metal board.

2. The antenna device of claim 1 further comprising a plastic cap, wherein the plastic cap is disposed among the front glass shell, the rear glass shell, and the metal bracket, the plastic cap is filled into the opening.

3. The antenna device of claim 1, wherein the opening is substantially L-shaped.

4. The antenna device of claim 1, wherein the printed antenna comprises a circuit board and a first radiating component, a second radiating component, and an isolating component which are printed on the circuit board, the opening exposes at least one of the first and second radiating components.

5. The antenna device of claim 4, wherein the isolating component is disposed between the first and second radiating components.

6. The antenna device of claim 4, wherein the isolating component comprises a first end, a second end, and a matching circuit which disposed between the first and second ends, the first end is a grounding end, and the second end is electrically connected to the metal bracket.

7. The antenna device of claim 6, wherein the matching circuit comprises an inductance element and a capacitive element connected in series.

8. The antenna device of claim 1, wherein the front glass shell and the rear glass shell comprise high alumina glass.

* * * * *